US006456017B1

(12) United States Patent
Bae et al.

(10) Patent No.: US 6,456,017 B1
(45) Date of Patent: Sep. 24, 2002

(54) ELECTRON GUN FOR CATHODE RAY TUBE

(75) Inventors: Min-cheol Bae, Suwon (KR); Kyu-hong Lee, Suwon (KR)

(73) Assignee: Samsung SDI Co., LTD, Kyungki-Do (KR)

( * ) Notice: Subject to any disclaimer, the term of this patent is extended or adjusted under 35 U.S.C. 154(b) by 0 days.

(21) Appl. No.: 09/684,339

(22) Filed: Oct. 10, 2000

(30) Foreign Application Priority Data

Oct. 19, 1999 (KR) ..... 1999-45310

(51) Int. Cl.[7] ..... G09G 1/04

(52) U.S. Cl. ..... 315/369; 315/382; 315/368.16; 313/412; 313/428

(58) Field of Search ..... 315/369, 382, 315/382.1, 5, 5.19, 5.34, 14, 15, 368.15, 368.16; 313/412, 414, 413, 428

(56) References Cited

U.S. PATENT DOCUMENTS 4,701,678 A * 10/1987 Blacker et al. ..... 315/382
5,027,043 A * 6/1991 Chen et al. ..... 315/368
5,488,265 A * 1/1996 Chen ..... 313/414
5,818,157 A * 10/1998 Stil et al. ..... 313/414
5,909,079 A * 6/1999 Uchida et al. ..... 313/414
5,932,958 A * 8/1999 Watanabe et al. ..... 313/412
6,031,346 A * 2/2000 Shirai et al. ..... 315/382
6,144,151 A * 11/2000 Tojo et al. ..... 313/414
6,153,970 A * 11/2000 Chen et al. ..... 313/412
6,255,767 B1 * 7/2001 Lee et al. ..... 313/414

FOREIGN PATENT DOCUMENTS

KR 1990-0000959 1/1990
KR 1993-0012073 6/1993
KR 1998-030940 8/1998

* cited by examiner

*Primary Examiner*—Don Wong
*Assistant Examiner*—Tuyet T. Vo
(74) *Attorney, Agent, or Firm*—Leydig Voit & Mayer, Ltd.

(57) ABSTRACT

An electron gun for a cathode ray tube has a cathode structure, a control electrode, a screen electrode, focusing electrodes, and a final accelerating electrode. R, G, and B electron apertures of one pair of the focusing electrodes face each other to form a quadrupole lens unit, to which an AC voltage having a relatively low peak or a static voltage is applied to converge R, G, and B electron beams into one point, even when the electron beams deviate to the corner of a screen. Asymmetrical enlargement portions are included in the rims of each of the R and B electron beam apertures.

15 Claims, 7 Drawing Sheets

ELECTRON GUN FOR CATHODE RAY TUBE

BACKGROUND OF THE INVENTION

1. Field of the Invention

The present invention relates to an electron gun, and more particularly, to an electron gun for a cathode ray tube (CRT) having reshaped electron beam apertures.

2. Description of the Related Art

In general, an electron gun includes a triode consisting of a cathode structure, a control electrode and a screen electrode, a focusing electrode opposed to the screen electrode to form a pre-focusing lens and a final accelerating electrode opposed to the focusing electrode to form a main focusing lens.

If power is applied to a CRT, an electron gun emits electron beams from the cathode structure. The emitted electron beams pass through electron beam apertures of multiple electrodes and are focused and accelerated. The accelerated electron beams are selectively deflected by a deflection yoke installed at the cone portion of a bulb, and excite a phosphor screen on the inner surface of a panel, thereby displaying a picture image.

In the above-described CRT, in order to prevent enlargement or distortion of the spot of an electron beam landing on the phosphor screen due to a nonuniform magnetic field of a deflection yoke, a dynamic focusing method using a quadrupole lens, in which the cross section of an electron beam emitted from an electron gun is distorted in the opposite direction of the deflection magnetic field and the focus voltage applied to the electron gun is varied when the electron beam is scanned at the center or periphery of the phosphor screen, has been employed.

FIG. 1 shows the first embodiment of parts of electrodes of an electron gun based on the dynamic focusing method, and FIG. 2 is a view in elevation and in section of FIG. 1.

Referring to FIGS. 1 and 2, the focusing electrode of the electron gun includes a static electrode 10 to which a static focusing voltage VF1 is applied, and a dynamic electrode 100 which faces the static electrode 10 and to which a dynamic voltage DF varying in synchronization with a deflection signal is applied.

The electrodes 10 and 100 include outer electrodes 12 and 120 having separate electron beam apertures 11 and 110, and auxiliary electrodes 14 and 140 inside the outer electrodes 12 and 120 and arranged in-line, respectively. The auxiliary electrodes 14 and 140 have three separate apertures 13*b*/13*a*/13*c* and 130*b*/130*a*/130*c* for R, G and B electron beams so that electrons emitted from cathode structure are focused and accelerated by an electronic lens formed between each of the-respective electrodes according to application of a voltage.

Here, the diameters of the G electron beam apertures 13*a* and 130*a* formed in the center, among the three separate apertures 13*b*/13*a*/13*c* and 130*b*/130*a*/130*c*, are equal. However, the diameters of the R and B electron beam apertures 13*b*/13*c* and 130*b*/130*c* arranged at opposite sides of the G electron beam apertures 13*a* and 130*a* are different.

In other words, whereas the R and B electron beam apertures 13*b* and 13*c* are equal to the G electron beam aperture in diameter in the static electrode 10, the diameter of the R or B electron beam aperture 130*b* or 130*c* is greater than that of the G electron beam aperture 130*a* in the dynamic electrode 100.

Accordingly, the central axes of the R electron apertures 13*b* and 130*b* are spaced apart by a distance D, and the central axes of the B electron beam apertures 13*c* and 130*c* are also spaced apart by the same distance, as shown in FIG. 2. As described above, asymmetry in electric fields of the electronic lens formed between each of various electrodes makes it easier to adjust convergence.

However, when a dynamic voltage is applied to the final focusing electrode, that is, the dynamic electrode 100, since the focusing force of the final focusing electrode changes, the focusing force for converging three electron beams onto a phosphor screen changes accordingly. Thus, the capability of correcting convergence at the screen corner is deteriorated, thereby lowering picture quality.

In order to manufacture an electron gun having the electrodes 10 and 100, electrodes are arranged on a zig rod for assembling the electron gun, and spacers for maintaining a gap between each of the respective electrodes are interposed and then assembled. The assembled electrodes are fusion-fixed within the neck portion of a bulb by pressing buried portions at edges of the electrodes when bead glass positioned at both sides of each electrode is semi-fused.

However, in the above-described electrodes 10 and 100, the axis between centers of R electron beam apertures 13*b* and 130*b* and the axis between centers of B electron beam apertures 13*c* and 130*c* are spaced a predetermined distance D apart from each other. Thus, when the electrodes 10 and 100 are inserted into a zig, the R and B electron beam apertures 130*b* and 130*c* having relatively larger diameters become eccentrically disposed from the zig rod, which makes it difficult to attain alignment, resulting in poor assembling efficiency.

Although the electrode structure disclosed in U.S. Pat. No. 4,701,678 can easily adjust convergence, it is very difficult to fabricate.

In detail, as shown in FIGS. 3 and 4, facing electrodes 30 and 300 according to another conventional example are substantially trapezoidal laterally. In the electrodes 30 and 300, R electron beam apertures 32 and 320 and B electron beam apertures 33 and 330 are tilted toward the edges of G electron beam apertures 31 and 310 at a predetermined angle.

In this case, a problem is encountered in controlling tolerance since the R electron beam apertures 32 and 320 and the B electron beam apertures 33 and 330 are tilted from the top surfaces of the electrodes 30 and 300.

Also, the electrode structure disclosed in U.S. Pat. No. 5,027,043 exhibits deteriorated focusing characteristic.

In still another conventional electrode structure shown in FIGS. 5 and 6, outer electrodes 50 and 500 are provided and separate small, R, G and B electron beam apertures 52 and 520 are formed on top surfaces of the outer electrodes 50 and 500.

Here, enlargement portions 530 protruding from the rims of the R and B electron beam apertures 520*b* and 520*c* toward a G electron beam aperture 520*a*, are formed in the static electrode 500.

In this case, electron beams converge toward the enlargement portions 530. Thus, in spite of relatively easy assembling work, electron beam spots are locally distorted, thereby degrading the quality of a picture. Accordingly, the above-described electrode structure is not suitable for a high resolution CRT to which high-current electron beams are applied.

SUMMARY OF THE INVENTION

To solve the above problems, it is an objective of the present invention to provide an improved electron gun for a cathode ray tube (CRT) which can easily adjust convergence by changing the shape of electron beam apertures of electrodes, and which can reduce a position error when being assembled.

Accordingly, to achieve the above objective, there is provided an electron gun for a cathode ray tube having a triode consisting of a cathode structure, a control electrode and a screen electrode, a plurality of focusing electrodes for forming a pre-focusing lens unit for pre-focusing and accelerating R, G and B electron beams emitted from the triode, and a final accelerating electrode facing the focusing electrodes, for forming a main lens unit, wherein among R, G and B electron apertures of one of the focusing electrodes facing each other to form a quadrupole lens unit, to which an AC voltage having a relatively low peak, or a static voltage, is applied, enlargement portions which are asymmetrical with respect to the central axes of the respective electron beam apertures are formed into the rim of each of the R and B electron beams, so that the R, G and B electron beams are converged into one point even when the electron beams deviate to the corner of a screen.

Also, first and second vertically elongated polygonal or non-circular enlargement portions, with central axes spaced a predetermined distance from the centers of the R and B electron beam apertures, are formed into the rims of the R and B electron beams on opposite sides of the rims in the lateral direction.

Also, a third vertically elongated polygonal or non-circular enlargement portion, with a central axis coinciding with the center of the G electron beam aperture, is formed into the rim of the G electron beam aperture on opposite sides of the rim.

Further, the first and second enlargement portions deviate from the centers of the R and B electron beam apertures toward the G electron beam aperture.

The distance between each of the centers of the R and B electron beam apertures and the center of the G electron beam aperture is different from the distance from each of the central axes of the first and second enlargement portions to the central axis of the third enlargement portion.

Also, the distance between each of the centers of the R and B electron beam apertures and the center of the G electron beam aperture is greater than the distance from each of the central axes of the first and second enlargement portions to the central axis of the third enlargement portion.

Further, the sum of each of diameters of the R and B electron beam apertures and lengths of the first and second enlargement portions is different from the sum of the diameter of the G electron beam aperture and the length of the third enlargement portion, in view of the vertical direction of the electrode system.

According to another aspect of the present invention, there is provided an electron gun for a cathode ray tube having a triode consisting of a cathode structure, a control electrode and a screen electrode, a plurality of focusing electrodes for forming a pre-focusing lens unit for pre-focusing and accelerating R, G and B electron beams emitted from the triode, and a final accelerating electrode facing the focusing electrodes, for forming a main lens unit, wherein among R, G and B electron apertures of one of the focusing electrodes facing each other to form a quadrupole lens unit, first and second vertically elongated enlargement portions are formed into the rim of the R electron beam aperture on opposite sides of the rim in the lateral direction, and third and fourth vertically elongated enlargement portions are formed into the rim of the B electron beam aperture on opposite sides of the rim in the lateral direction, the respective enlargement portion having predetermined lengths in the normal direction of the horizontal axis of the electron beam apertures, so that the R, G and B electron beams are converged into one point even when the R, G and B electron beams deviate to the corner of a screen Also, fifth and sixth enlargement portions having the same width and length may be formed into the rim of the G electron beam aperture on opposite sides of the rim in the lateral direction.

The width of each of the first and second enlargement portions is preferably different from the width of each of the third and fourth enlargement portions.

BRIEF DESCRIPTION OF THE DRAWINGS

The above objective and advantages of the present invention will become more apparent by describing in detail a preferred embodiment thereof with reference to the attached drawings in which.

DESCRIPTION OF THE PREFERRED EMBODIMENTS

An electron gun according to a first embodiment of the present invention will now be described in detail with reference to the accompanying drawings.

Figure 1:
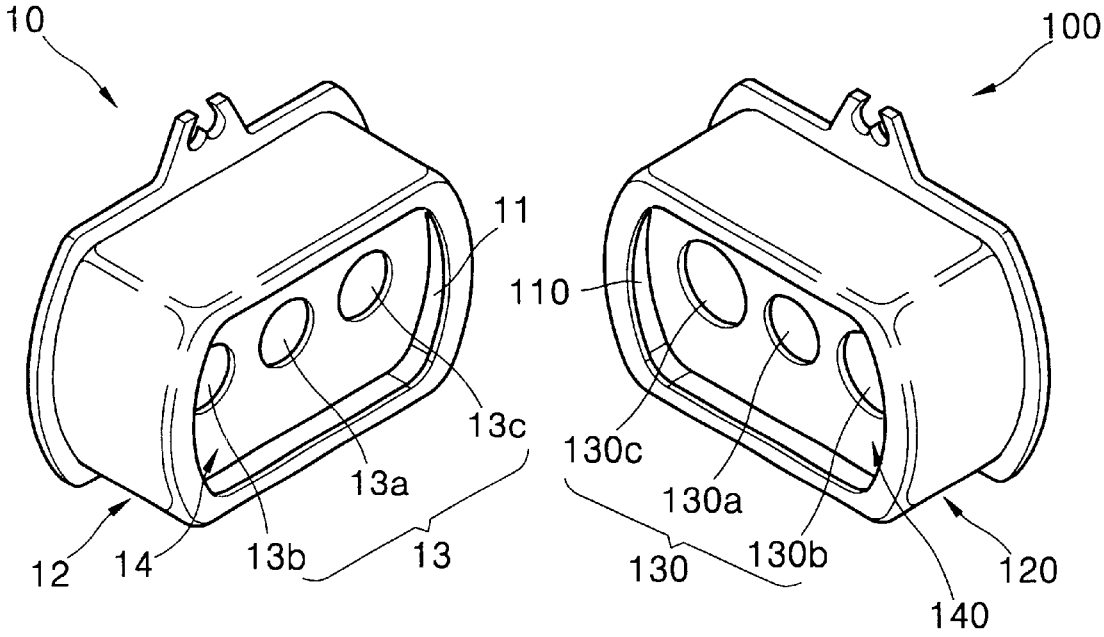
FIG. 1 (PRIOR ART)
FIG. 1 is an exploded perspective view partially illustrating a conventional electrode structure of an electron gun.
Figure 2:
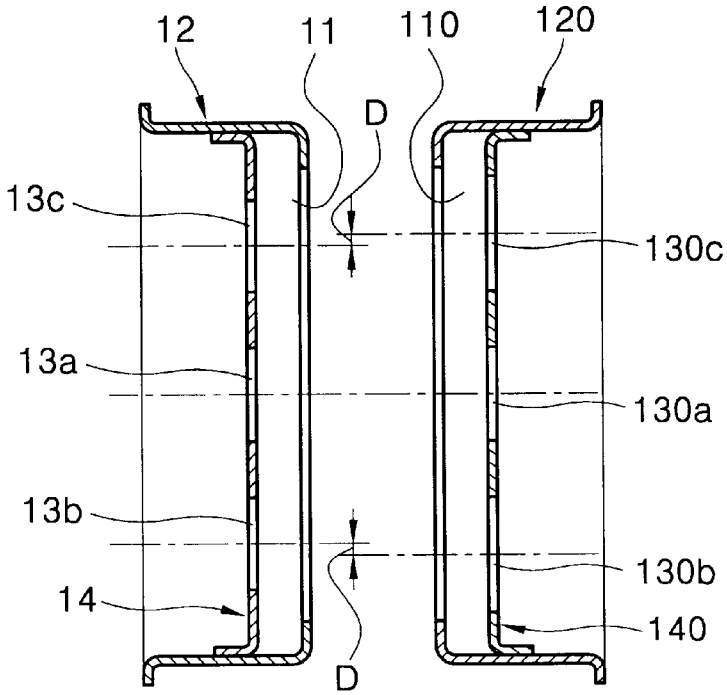
FIG. 2 (PRIOR ART)
FIG. 2 is a view in elevation and partially in section of the electrode structure shown in FIG. 1.
Figure 3:
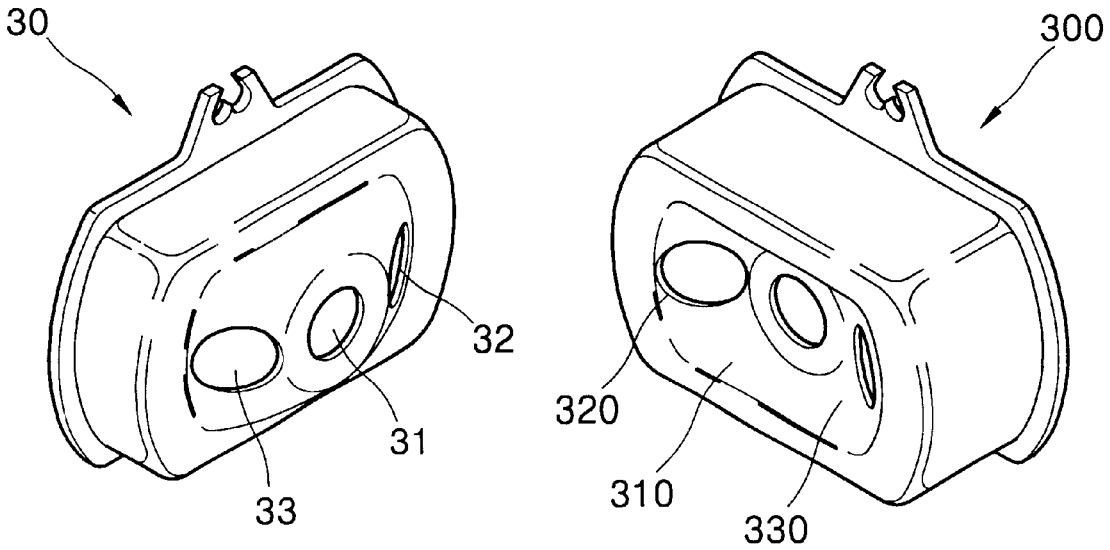
FIG. 3 (PRIOR ART)
FIG. 3 is an exploded perspective view partially illustrating another conventional electrode structure of an electron gun.
Figure 4:
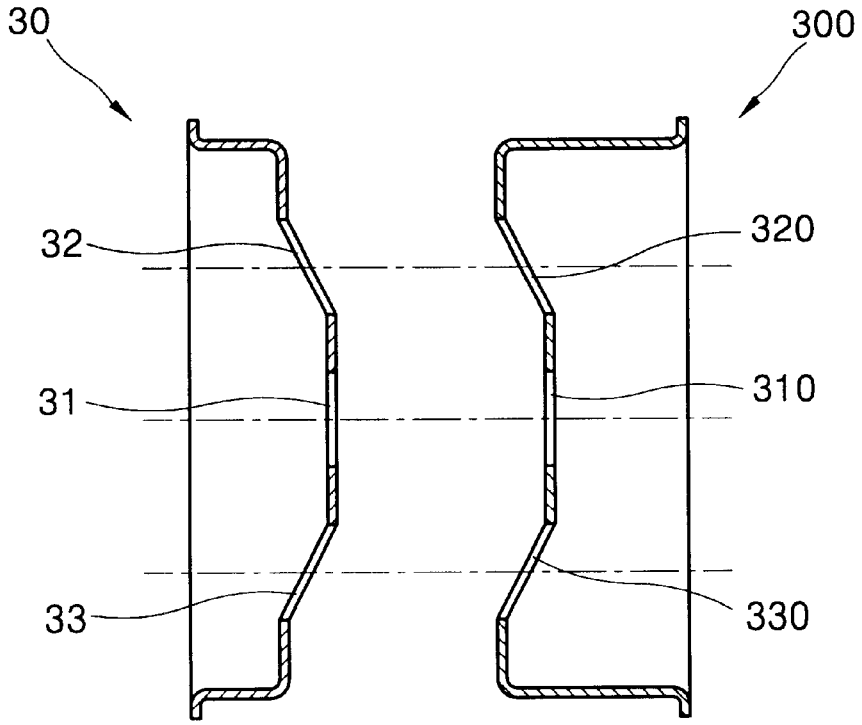
FIG. 4 (PRIOR ART)
FIG. 4 is a view in elevation and partially in section of the electrode structure shown in FIG. 3.
Figure 5:
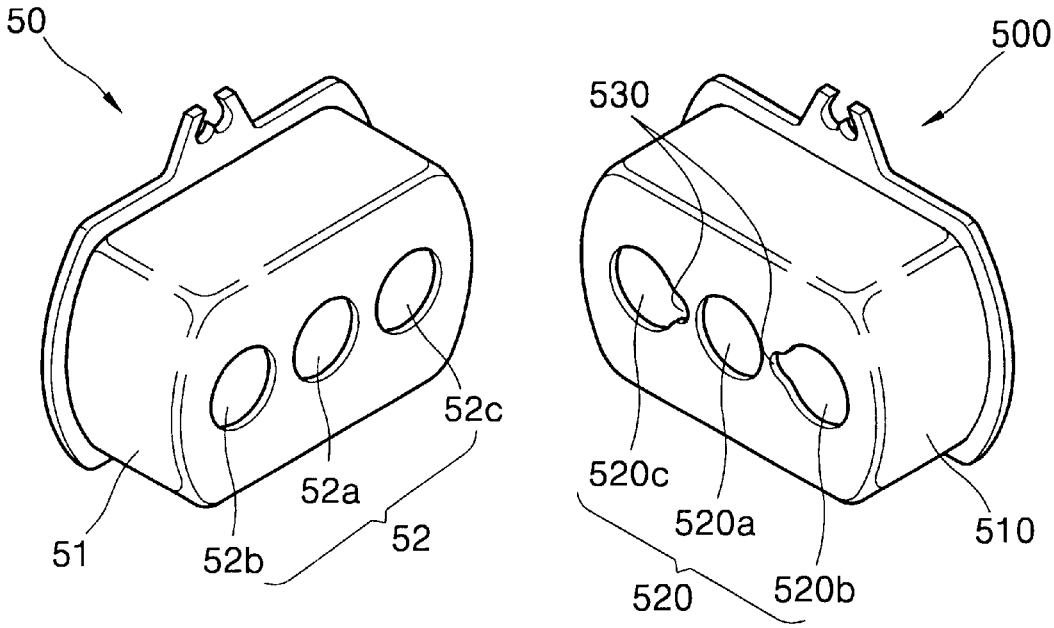
FIG. 5 (PRIOR ART)
FIG. 5 is an exploded perspective view partially illustrating still another conventional electrode structure of an electron gun.
Figure 6:
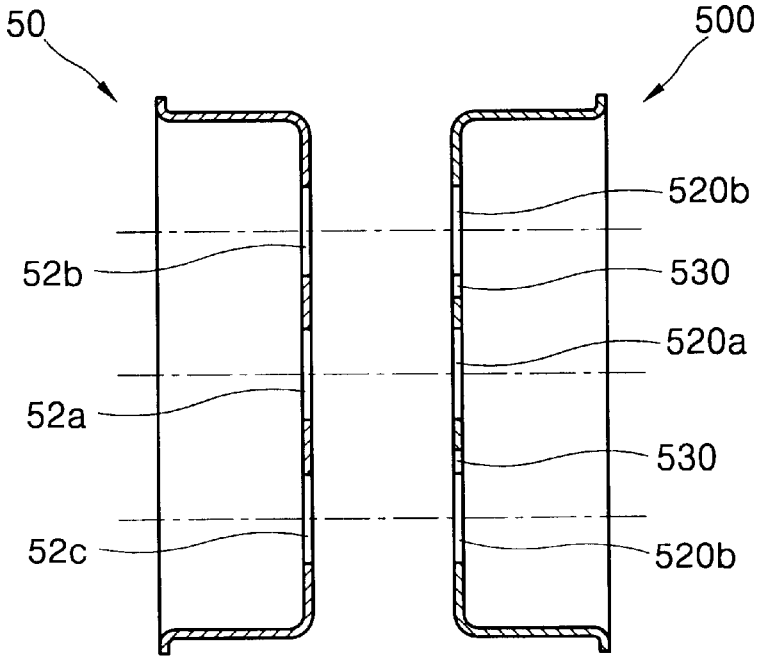
FIG. 6 (PRIOR ART)
FIG. 6 is a view in elevation and partially in section of the electrode structure shown in FIG. 5.
Figure 7:
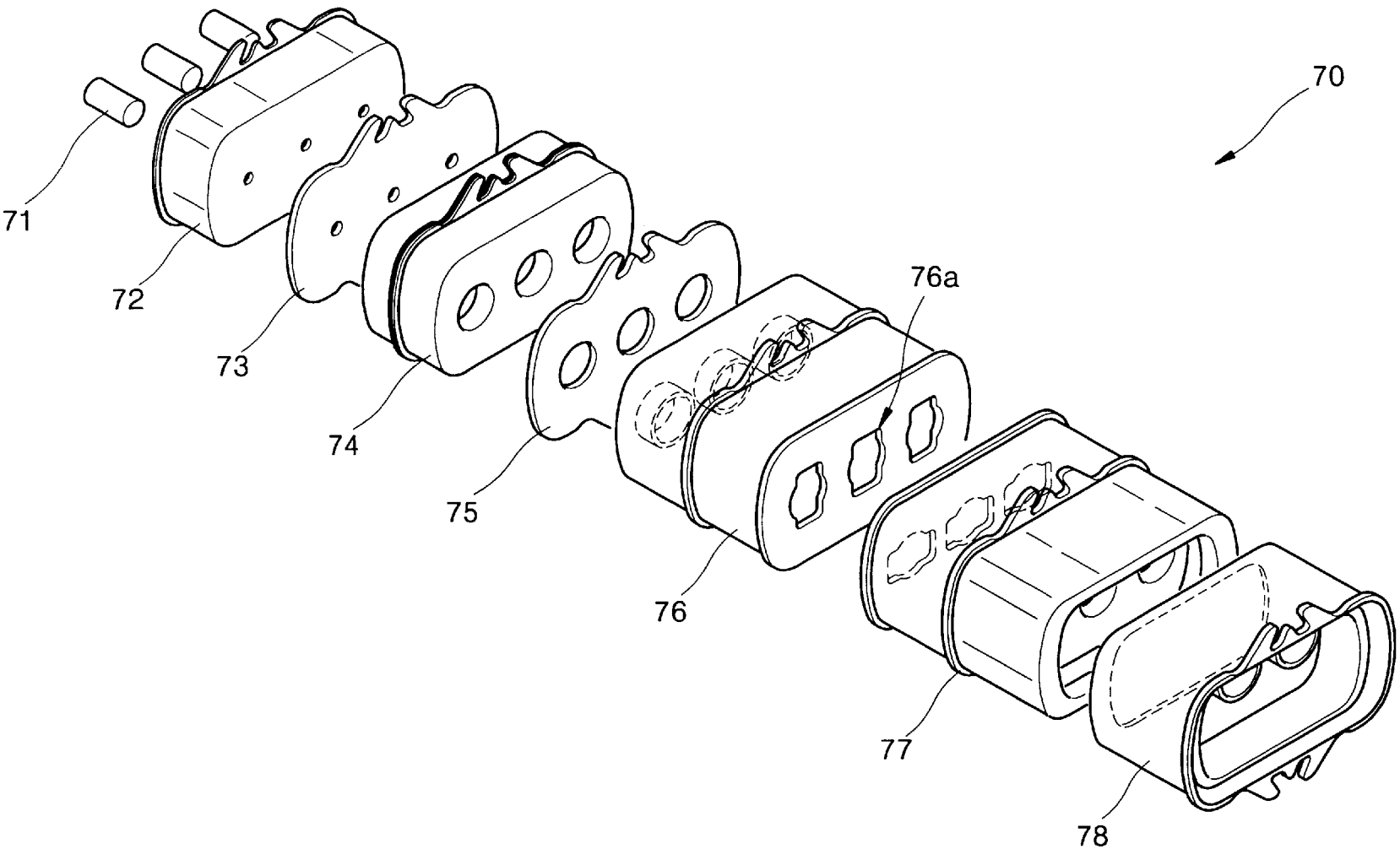
FIG. 7 an exploded perspective view partially illustrating an electron gun according to a first embodiment of the present invention.

FIG. 7 illustrates an electron gun 70 according to a first embodiment of the present invention.

Referring to FIG. 7, the electron gun 70 includes a triode with a cathode structure 71 which is an emitting source of thermal electrons, a control electrode 72 for controlling the quantity of electrons emitted from the cathode structure 71 having an external signal, and a screen electrode 73.

Also the electron gun 70 includes first, second, third and fourth focusing electrodes 74, 75, 76 and 77 aligned with to the screen electrode 73, for forming an electronic lens portion for focusing and accelerating electron beams, and a final accelerating electrode 78 located in the vicinity of a final focusing electrode, that is, the fourth focusing electrode 77, to form a main lens portion.

In the above-described electron gun 70, the number of focusing electrodes is not limited to the number described herein and can be increased according to the formation state of the electronic lens portion for focusing electron beams in multiple stages. Three electron beam apertures through which electron beams for exciting R, G and B phosphors are arranged in-line in the respective electrodes. The shapes of the electron beam apertures may be varied according to the sizes of the electronic lenses formed between each electrodes. Alternatively, separate large electron beam apertures may be formed in the electrodes, thereby forming an electronic lens unit through which all of three electron beams pass. These electrodes are fused to bead glass (not shown) installed at both sides of the electron gun 70 at the neck portion of a bulb so they are fixed in position.

Here, a static focusing voltage VF1 is applied to the third focusing electrode 76 constituting a quadrupole lens portion, a dynamic focus voltage VF2 having a dynamic voltage DF synchronously varying with a deflection signal added thereto, is applied to the fourth focusing electrode 77, and a high-potential anode voltage VA higher than the voltage applied to any of the electrodes mentioned above, is applied to the final accelerating electrode 78.

Here, an asymmetrical deviating portion is formed on a static electrode, that is, the third focusing electrode 76, so electron beam apertures 76*a* in plane facing a dynamic electrode, that is, the fourth focusing electrode 77, compensates for convergence.

Figure 8:
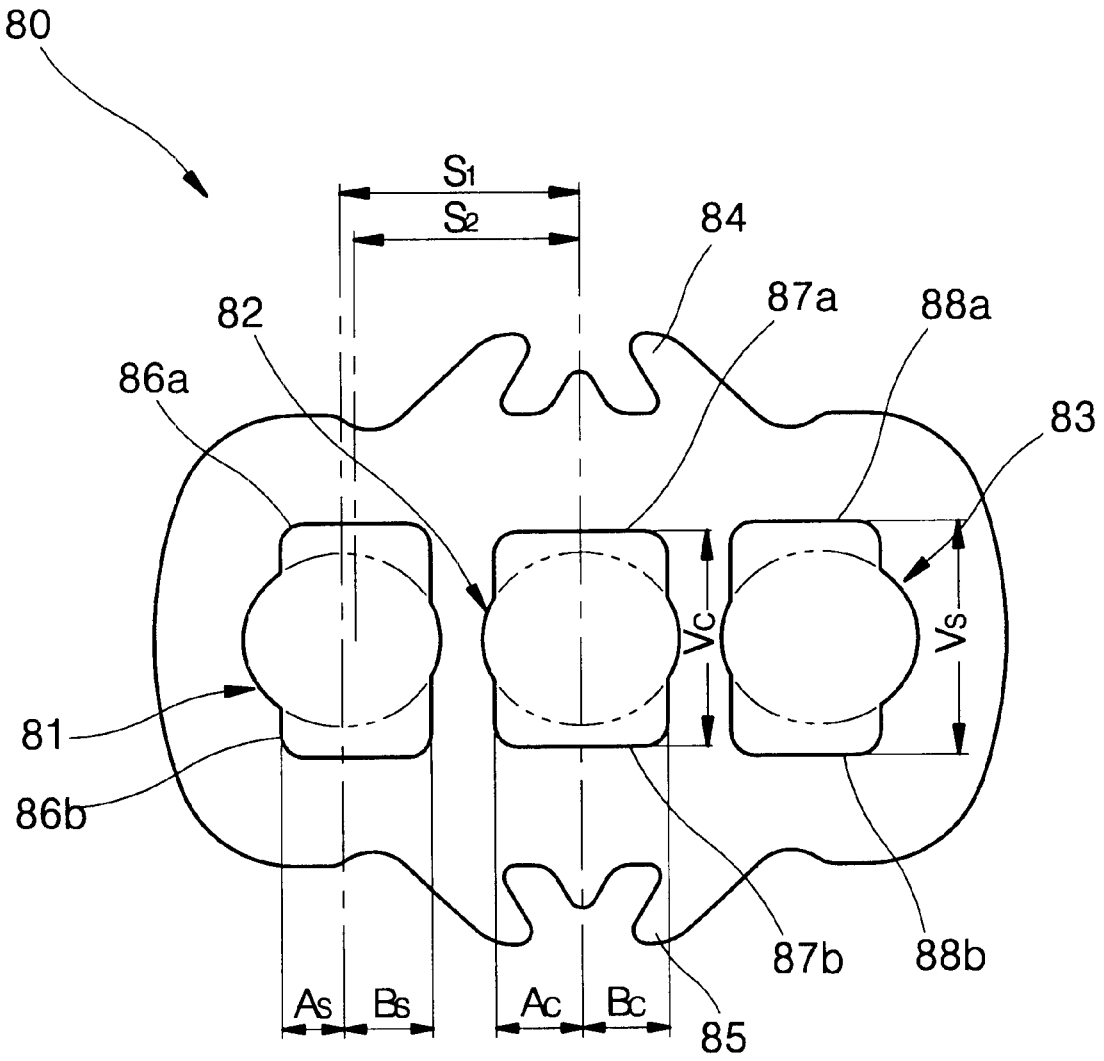
FIG. 8 is a plan view of an electrode shown in FIG. 7.

FIG. 8 is a plan view of an exemplary static electrode 80.

Referring to FIG. 8, the electrode 80 has three separate small apertures 81, 82 and 83 through which R, G and B electron beams emitted from a cathode structure (71 of FIG. 7) and focused and accelerated by electronic lenses formed between each of the electrodes, pass. Burying portions 84 and 85 to be fused to bead glass are located in the mid portion of the periphery of the electrode 80.

Here, enlargement portions are located along the rim of each of the electron beam apertures 81, 82 and 83. In detail, fifth and sixth enlargement portions 87*a* and 87*b* extended lengthwise, i.e., vertically, in FIG. 8, with respect to the electrode 80. The fifth and sixth enlargement portions 87*a* and 87*b* extend from the rim of the G electron beam aperture 82 on opposite sides of the rim in the vertical direction. The fifth and sixth enlargement portions 87*a* and 87*b* have polygonal or non-circular shapes. Here, the central axes of the fifth and sixth enlargement portions 87*a* and 87*b* coincide with the center of the G electron beam aperture 82.

In the R and B electron beam apertures 81 and 83, first and second enlargement portions 86*a* and 86*b* and third and fourth enlargement portions 88*a* and 88*b* extended lengthwise, ie, vertically, in FIG. 8, with respect to the electrode 80. The first and second enlargement portions 86*a* and 86*b* and the third and fourth enlargement portions 88*a* and 88*b* extended from the rims of the R and B electron beam apertures 81 and 83 on opposite sides of the rims in the vertical direction, respectively. Like the G electron beam aperture 82, the first and second enlargement portions 86*a* and 86*b* and the third and fourth enlargement portions 88*a* and 88*b* have polygonal or non-circular shapes.

Here, the centers of the R and B electron beam apertures 81 and 83 do not coincide with the central axes of the first and second enlargement portions 86*a* and 86*b* and the third and fourth enlargement portions 881 and 88*b*. In other words, the first and second enlargement portions 86*a* and 86*b* deviate from the center of the R electron beam aperture 81 toward the G electron beam aperture 82. Also, the third and fourth enlargement portions 88*a* and 88*b* deviate from the center of the B electron beam aperture 83 toward the G electron beam aperture 82.

Accordingly, an asymmetric electric field is formed at the R, G and B electron beam apertures 81, 82 and 83 lengthwise with respect to the electrode 80. Thus, the capability of correcting electron beam convergence is improved.

In more detail, assuming that $S_1$ represents the distance between the centers of the R and B electron beam apertures 81 and 83 disposed all the left and right sides of the G electron beam aperture 82 and the center of the G electron beam aperture 82 and $S_2$ represents the distance between the central axes of the fifth and sixth enlargement portions 87*a* and 87*b* and the central axes of the first and second enlargement portions 86*a* and 86*b* or the third and fourth enlargement portions 88*a* and 88*b*, $S_1$ is not equal to $S_2$. Instead, when $S_1$ is greater than $S_2$, an asymmetric field is formed, which is advantageous for convergence control.

It is assumed that $V_C$ represents the sum of the diameter of the G electron beam aperture 82 and vertical lengths of the fifth and sixth enlargement portions 87*a* and 87*b* and $V_S$ represents the sum of the respective diameters of the R and B electron beam apertures 81 and 83 and vertical lengths of the first and second enlargement portions 86*a* and 86*b* or the third and fourth enlargement portions 88*a* and 88*b*. Then, $V_C$ is not equal to $V_S$, and it is advantageous that $V_S$ is greater than $V_C$.

Also, it is assumed that $A_S$ represents the horizontal lengths, ie, widths of the first and second enlargement portions 86*a* and 86*b* or the third and fourth enlargement portions 88*a* and 88*b* from the respective centers of the R and B electron beam apertures 81 and 83 toward the periphery of the electrode 80, $B_S$ represents the horizontal lengths, i.e., widths of the first and second enlargement portions 86*a* and 86*b* or the third and fourth enlargement portions 88*a* and 88*b* from the respective centers of the R and B electron beam apertures 81 and 83 toward the G electron beam aperture 82, $A_C$ represents the horizontal lengths i.e., width of the fifth and sixth enlargement portions 87*a* and 87*b* from the center of the G electron beam aperture 82 toward the first and second enlargement portions 86*a* and 86*b* , and $B_C$ represents the horizontal lengths, i.e., widths of the fifth and sixth enlargement portions 87*a* and 87*b* from the center of the G electron beam aperture 82 toward the third or fourth enlargement portion 86*a* or 86*b*. Then, it is advantageous in forming an asymmetric electric field that the sum of $A_S$ and $B_S$ is not equal to the sum of $A_C$ and $B_C$. Here, $A_C$ equals $B_C$.

Likewise, the first and second enlargement portions 86*a* and 86*b* and the third and fourth enlargement portions 88*a* and 88*b* are shaped such that a polygon, e.g., a rectangle or an ellipse, is superposed over each of the R and B electron beam apertures 81 and 83 lengthwise with respect to the electrode 80. Only the centers of the first and second enlargement portions 86*a* and 86*b* and the third and fourth enlargement portions 88*a* and 88*b* are shifted, without shifting the centers of the R and B electron beam apertures 81 and 83, to form an asymmetric electric field with respect to the corresponding dynamic electrode, thereby attaining quadrupolar effects. Also, since the asymmetric electric field is horizontally formed, convergence control is easily achieved.

Also, the strength of a quadrupole lens is adjusted by varying the vertically elongated length of the R and B electron beam apertures 81 and 83, inclusive of the superposed first and second enlargement portions 86*a* and 86*b* and the third and fourth enlargement portions 88*a* and 88*b*, thereby maximizing the correcting capability of the quadrupole lens for the G electron beam and the R and B electron beams, without affecting convergence.

Figure 9:
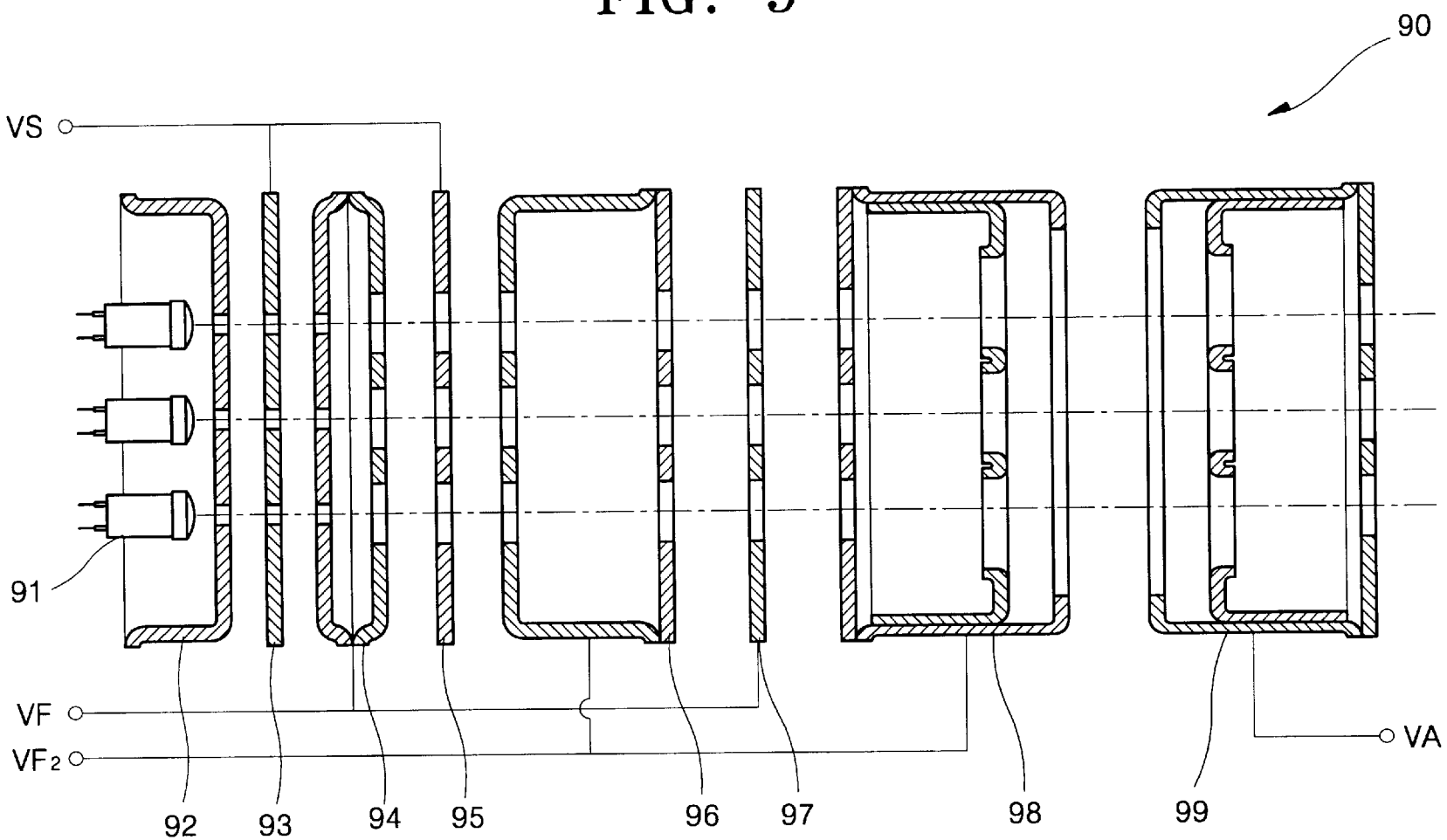
FIG. 9 is a view in elevation and partially in section of an electron gun according to a second embodiment of the present invention.

FIG. 9 illustrates an electron gun 90 according to a second embodiment of the present invention.

Referring to FIG. 9, the electron gun 90 includes a triode consisting of a cathode structure 91 which is an emission source of thermal electrons, a control electrode 92 for controlling the quantity of electrons emitted from the cathode structure 91 by an external signal, and a screen electrode 93.

Also, the electron gun 90 includes first, second, third, fourth and fifth focusing electrodes 94, 95, 96, 97 and 98 aligned with the screen electrode 93, for forming an electronic lens portion for focusing and accelerating electron beams, and a final accelerating electrode 99 for forming a main lens portion together with the fifth focusing electrode 98.

Here, a predetermined potential is applied to the respective electrodes. In other words, a static voltage VS is applied to the screen electrode 93 and the second focusing electrode 95, a static focusing voltage $VF_1$ is applied to the first focusing electrode 94 and the fourth focusing electrode 97, and a dynamic focusing voltage $VF_2$ having a dynamic voltage VD synchronously varying with a deflection signal added thereto, is applied to the third and fifth focusing electrodes 96 and 98. a high-potential anode voltage VA higher than the voltage applied to any of the electrodes mentioned above, is applied to the final accelerating electrode 98.

Here, since the fourth focusing electrode 97 which is a static electrode has an electron beam aperture asymmetrically deviating and the centers of the respective electron beam apertures are positioned on the same axis, as shown in FIGS. 7 and 8, a detailed explanation thereof will not be given.

Figure 10:
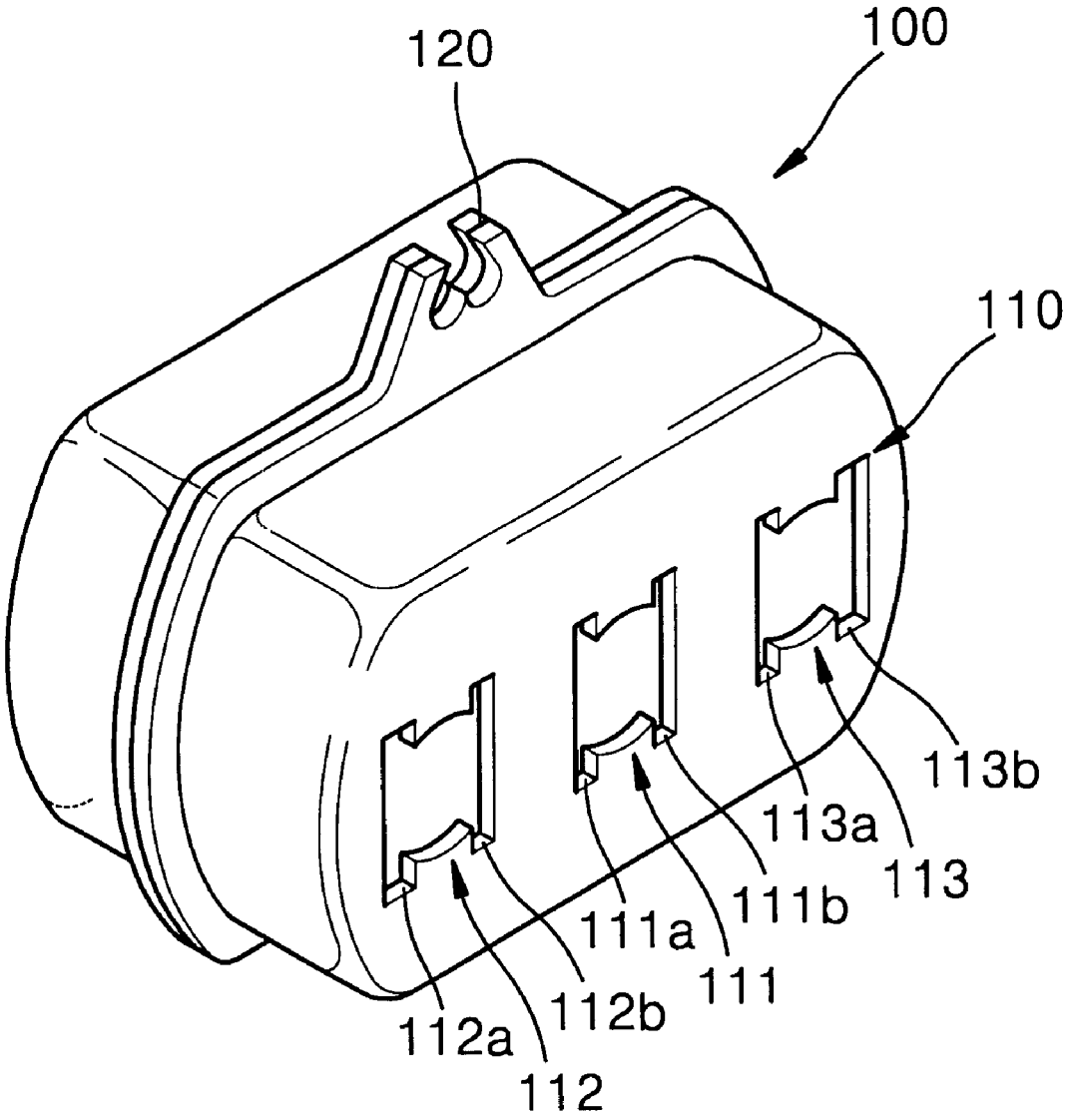
FIG. 10 is a perspective view partially illustrating an electron gun according to a third embodiment of the present invention.

FIG. 10 illustrates a focusing electrode 100 according to a third embodiment of the present invention, to which a dynamic voltage is applied.

Referring to FIG. 10, the electrode 100 has on its top surface three separate small apertures 110 through which electron beams emitted from a cathode structure and focused and accelerated by electronic lens portions located between each of the electrodes, pass. Buried portions 120 to be fused to bead glass in the neck portion of a bulb are formed in the mid portion of the periphery of the electrode 100.

The electron beam apertures 110 are formed in an in-line arrangement so as to share the same central axis. In other words, a G electron beam aperture 111 is located in the center of the electrode 100, and R and B electron beam apertures 112 and 113 are located at both sides of the G electron beam aperture 111.

Here, enlargement portions are located in the rim of each of the electron beam apertures 110. In other words, fifth and sixth vertically elongated enlargement portions 111*a* and 111*b* are located in the rim of the G electron beam aperture 111 on opposite sides of the rim in the lateral direction. The fifth and sixth enlargement portions 111*a* and 111*b* have the same width and length.

First and second enlargement portions 112*a* and 112*b* and third and fourth enlargement portions 113*a* and 113*b* are also located at the R and B electron beam apertures 112 and 113 lengthwise with respect to the electrode 100, respectively. In this case, the first and second enlargement portions 112*a* and 112*b* and the third and fourth enlargement portions 113*a* and 113*b* are preferably located asymmetrically in the normal direction from the rims of the R and B electron beam apertures 112 and 113, unlike the fifth and sixth enlargement portions 111*a* and 111*b* which are symmetrical with respect to the center of the G electron beam aperture 111, in order to increase the quadrupolar effect and convergence adjusting capability of an electrode to which an AC dynamic voltage having a relatively high peak is applied.

In other words, the first and second enlargement portions 112*a* and 112*b* and the third and fourth enlargement portions 113*a* and 113*b* have a predetermined length at the lateral rims of the R and B electron beam apertures 112 and 113, with respect to the electrode 100. The first and second enlargement portions 112*a* and 112*b* and the third and fourth enlargement portions 113*a* and 113*b* are integral with the R and B electron beam apertures 112 and 113. Here, it is advantageous for convergence control to make the widths and lengths of the first and second enlargement portions 112*a* and 112*b* different from each other, and to make the widths and lengths of the third and fourth enlargement portions 113*a* and 113*b* different from each other.

When the aforementioned electrode structure of an electron gun is assembled, the respective electrodes are arranged along the zig rod and a spacer having a predetermined thickness is interposed between each two of the respective electrodes in order to maintain a predetermined distance between the respective electrodes.

Here, since, the central axes of the R, G and B electron beam apertures are symmetrically located, ecentricity does not occur at the zig rod when the electrodes are inserted into the zig rod, thereby easily attaining alignment. In this state, the respective electrode elements are fused to bead glass disposed at both sides of the electrodes. Accordingly, a proper distance between the respective electrodes are maintained to achieve high precision alignment of electrode elements, thereby showing stable functions.

As described above, in the electron gun for a CRT according to the present invention, a quadrupole lens system includes electrodes aligned such that the diameter and center of the electron beam apertures at one of electrodes to which a dynamic focusing voltage is applied, coincide, and asymmetric enlargement portions are located at predetermined portions of rims of the electron beam apertures, thereby facilitating convergence control. Also, since eccentricity does not occur at the zig rod during fabrication, the assembling process is simplified.

Having described the exemplary embodiments of the present invention, various changes and equivalent embodiments may be made by those skilled in the art without departing from the spirit and scope of the appended claims. It is therefore contemplated that the true scope of the invention be set forth in the following claims.

What is claimed is:

1. An electron gun for a cathode ray tube having:

a triode including a cathode structure, a control electrode, and a screen electrode, a plurality of focusing electrodes forming a pre-focusing lens unit for pre-focusing and accelerating R, G, and B electron beams emitted from the triode, and a final accelerating electrode facing the focusing electrodes, forming a main lens unit, wherein R, G, and B electron beam apertures of one pair of the focusing electrodes face each other and form a quadrupole lens unit, to which one of an AC voltage having a relatively low peak and a static voltage is applied, and respective centers of the R, G, and B electron beam apertures lie on a straight line, rims of each of the R and B electron beam apertures include respective enlargement portions having a plurality of straight line segments and respective circular portions intersecting the enlargement portions so that each of the R and B electron beam aperture rims includes straight line segments and arcs, and the enlargement portions include respective central axes passing through centers of the R and B electron beam apertures and perpendicular to the straight line, not intersecting the respective centers of the circular portions of the R and B electron beam apertures, so that the R, G, and B electron beams, respectively passing through the R, G, and B electron beam apertures, are converged to a single point even when the electron beams are deflected to a corner of a screen of a cathode ray tube including the electron gun, the G electron beam aperture has a rim including a circular portion and an enlargement portion having a plurality of straight line segments, and the enlargement portion of the G electron beam aperture has a central axis perpendicular to the straight line and intersecting the center of the circular portion of the G electron beam aperture, and each of the circular portions of the R, G, and B electron beam apertures has a respective diameter, each of the enlargement portions of the R, G, and B electron beam apertures has a respective length perpendicular to the straight line, and the respective sums of each of the diameters of the circular parts of the R and B electron beam apertures and the lengths of the enlargement portions of the R and B electron beam apertures are different from the sum of the diameter of the circular part of the G electron beam aperture and the length of the enlargement portion of the G electron beam aperture.

2. The electron gun according to claim 1, wherein each of the respective distances along the straight line between the centers of the circular portions of the R and B electron beam apertures and the center of the G electron beam aperture are different from each of the respective distances along the straight line between the central axes perpendicular to the first line of the enlargement portions of the R and B electron beam apertures and the central axis of the enlargement portion of the G electron beam aperture perpendicular to the straight line.

3. The electron gun according to claim 1, wherein each of the respective distances along the straight line between the centers of the circular portions of the R and B electron beam apertures and the center of the G electron beam aperture are larger than each of the respective distances along the straight line between the central axes perpendicular to the first line of the enlargement portions of the R and B electron beam apertures and the central axis of the enlargement portion of the G electron beam aperture perpendicular to the straight line.

4. The electron gun according to claim 1, wherein the respective sums of each of the diameters of the circular parts of the R and B electron beam apertures and the lengths of the enlargement portions of the R and B electron beam apertures are larger than the sum of the diameter of the circular part of the G electron beam aperture and the length of the enlargement portion of the G electron beam aperture.

5. The electron gun according to claim 1, wherein the enlargement portions of the R, G, and B electron beam apertures have respective widths along the straight line, and the widths of each of the enlargement portions of the R and B electron beam apertures are different from the width of the enlargement portion of the G electron beam aperture.

6. The electron gun according to claim 1, wherein the enlargement portions of the R and B electron beam apertures have identical lengths transverse to the straight line and identical widths along to the straight line.

7. The electron gun according to claim 1, wherein the enlargement portions of the R, G, and B electron beam apertures have respective widths along the straight line, and the widths of each of the enlargement portions of the R and B electron beam apertures are smaller than width of the enlargement portion of the G electron beam aperture.

8. The electron gun according to claim 1, wherein the respective central axes of the elongated enlargement portions of the R and B electron beam apertures perpendicular to the straight line, are displaced from the respective axes that pass through the centers of the circular parts of the R and B electron beam apertures, toward the central axis of the G electron beam aperture that is perpendicular to the straight line.

9. The electron gun according to claim 8, wherein the enlargement portions of the R, G, and B electron beam apertures have respective widths along the straight line, and the widths of each of the enlargement portions of the R and B electron beam apertures are different from the width of the enlargement portion of the G electron beam aperture.

10. The electron gun according to claim 8, wherein the enlargement portions of the R and B electron beam apertures have identical lengths transverse to the straight line and identical widths along the straight line.

11. The electron gun according to claim 8, wherein the enlargement portions of the R, G, and B electron beam apertures have respective widths along the straight line, and the widths of each of the enlargement portions of the R and B electron beam apertures are smaller than width of the enlargement portion of the G electron beam aperture.

12. An electron gun for a cathode ray tube having:

a triode including a cathode structure, a control electrode, and a screen electrode, a plurality of focusing electrodes forming a pre-focusing lens unit for pre-focusing and accelerating R, G, and B electron beams emitted from the triode, and a final accelerating electrode facing the focusing electrodes, forming a main lens unit, wherein R, G, and B electron beam apertures of one pair of the focusing electrodes face each other and form a quadrupole lens unit, the R, G, and B electron beams having respective centers lying on a straight line in a width direction, pairs of first and second elongated enlargement portions extending transverse to the straight line, in a rim of the R electron beam aperture, and located respectively on each of opposite sides of the rim of the R electron beam aperture along the width direction, and pairs of third and fourth elongated enlargement portions perpendicular to the straight line, in a rim of the B electron beam aperture and located respectively on each of opposite sides of the rim of the B electron beam aperture along the width direction, the first, second, third, and fourth enlargement portions having lengths perpendicular to the straight line so that the R, G, and B electron beams passing through the R, G, and B electron beam apertures are converged to a single point even when the R, G, and B electron beams are deflected to a corner of a screen of a cathode ray tube including the electron gun.

13. The electron gun according to claim 12, including pairs of fifth and sixth enlargement portions extending perpendicular to the straight line, having identical widths, and identical lengths perpendicular to the straight line, in a rim of the G electron beam aperture, located respectively on each of opposite sides of the rim of the G electron beam aperture along the width direction.

14. The electron gun according to claim 12, wherein the widths of each of the enlargement portions of the pairs of the first and third enlargement portions, in the width direction, are different from the widths of each of the enlargement portions of the pairs of the second and fourth enlargement portions, in the width direction.

15. The electron gun according to claim 12, wherein lengths of each of the enlargement portions of the pairs of the first and third enlargement portions, perpendicular to the straight line, are different from lengths of each of the enlargement portions of the pairs of the second and fourth enlargement portions, perpendicular to the straight line.

* * * * *